US007005620B2

(12) United States Patent
Ribeiro et al.

(10) Patent No.: US 7,005,620 B2
(45) **Date of Patent: *Feb. 28, 2006**

(54) PISTON AND METHOD OF MANUFACTURE

(75) Inventors: Carmo Ribeiro, Ann Arbor, MI (US); Thomas Egerer, Ann Arbor, MI (US); Randall Gaiser, Chelsea, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 27 days.

This patent is subject to a terminal disclaimer.

(21) Appl. No.: 10/735,798

(22) Filed: Dec. 12, 2003

(65) Prior Publication Data

US 2005/0092739 A1 May 5, 2005

Related U.S. Application Data

(63) Continuation-in-part of application No. 10/701,274, filed on Nov. 4, 2003, now Pat. No. 6,825,450.

(51) Int. Cl.
*H05B 6/10* (2006.01)

(52) U.S. Cl. ..... 219/635; 219/639

(58) Field of Classification Search ..... 219/600–603, 219/615–617, 633–637, 639–642, 647, 652; 92/186; 29/888.09, 888.42; 285/288.1
See application file for complete search history.

(56) References Cited

U.S. PATENT DOCUMENTS

| | | | | |
|---|---|---|---|---|
| 3,319,536 A | | 5/1967 | Kohl et al. | 92/231 |
| 4,706,550 A | | 11/1987 | Bullat | 92/260 |
| 4,875,616 A | | 10/1989 | Nixdorf | 228/120 |
| 5,150,517 A | | 9/1992 | Leites et al. | 29/888.04 |
| 5,207,147 A | | 5/1993 | Leites et al. | 92/176 |
| 5,230,148 A | | 7/1993 | Leites et al. | 28/888.042 |
| 5,245,752 A | | 9/1993 | Lippai et al. | 29/888.042 |
| 5,309,818 A | | 5/1994 | Mendes et al. | 92/176 |
| 5,317,958 A | | 6/1994 | Leites et al. | 92/186 |
| 5,359,922 A | | 11/1994 | Leites et al. | 92/189 |
| 5,394,788 A | | 3/1995 | Mendes et al. | 92/176 |
| 5,549,335 A | * | 8/1996 | Wohrstein | 285/288.1 |
| 5,588,351 A | | 12/1996 | Lippai et al. | 92/208 |
| 6,032,619 A | | 3/2000 | Zhu et al. | 123/41.35 |
| 6,112,642 A | * | 9/2000 | Jarrett et al. | 92/186 |
| 6,155,157 A | | 12/2000 | Jarrett | 92/186 |
| 6,222,150 B1 | * | 4/2001 | Nomura et al. | 219/78.02 |
| 6,244,161 B1 | | 6/2001 | Myers et al. | 92/224 |
| 6,260,472 B1 | | 7/2001 | Zhu et al. | 92/214 |
| 6,279,455 B1 | | 8/2001 | Kruse | 92/186 |
| 6,291,806 B1 | | 9/2001 | Quick et al. | 219/633 |
| 6,371,061 B1 | | 4/2002 | Lash | 123/41.35 |
| 6,477,941 B1 | | 11/2002 | Zhu et al. | 92/186 |
| 6,491,013 B1 | | 12/2002 | Gaiser et al. | 123/193.6 |
| 6,499,387 B1 | | 12/2002 | Bedwell | 92/216 |
| 6,508,162 B1 | | 1/2003 | Bedwell | 92/222 |

(Continued)

*Primary Examiner*—Tu Hoang
(74) *Attorney, Agent, or Firm*—Howard & Howard

(57) ABSTRACT

A piston particularly adapted for heavy-duty diesel engine applications is fabricated from separate parts having circumferentially extending joining surfaces that are heated prior to bonding to an elevated temperature sufficient to enable bonding of the joining surfaces, and thereafter the joining surfaces brought into contact with one another and twisted to attain a permanent metallurgical weld at the interface of the joining surfaces. The piston has radially spaced walls which are both welded simultaneously. The weld joints may lie in the same or different planes. Once joined, and while still hot, the parts may be pulled apart slightly to reduce the wall thicknesses at the weld joint.

30 Claims, 6 Drawing Sheets

U.S. PATENT DOCUMENTS 6,508,240 B1 1/2003 Bedwell ..... 123/668
6,513,477 B1 2/2003 Gaiser et al. ..... 123/193.6
6,526,871 B1 3/2003 Zhu et al. ..... 92/231
6,539,910 B1 4/2003 Gaiser et al. ..... 123/193.6
6,557,514 B1 5/2003 Gaiser ..... 123/193.6
6,571,684 B1 6/2003 Nov et al. ..... 92/189
6,588,320 B1 7/2003 Gaiser et al. ..... 92/231
6,588,408 B1 7/2003 Bedwell et al. ..... 123/668
6,637,642 B1 10/2003 Lingnau ..... 228/112.1
6,736,305 B1 * 5/2004 Foster et al. ..... 219/617
6,825,450 B1 * 11/2004 Ribeiro et al. ..... 219/635
2002/0046593 A1 * 4/2002 Ribeiro et al. ..... 29/888.09

* cited by examiner

PISTON AND METHOD OF MANUFACTURE

BACKGROUND OF THE INVENTION

This application is a continuation-in-part of application Ser. No. 10/701,274, filed Nov. 4, 2003, now U.S. Pat. No. 6,825,450.

Various methods are known for bonding separately formed portions of a piston in order to yield a piston structure. One such process is friction welding in which one portion of the piston is rotated at high speed while pressed against the other portion, with the resulting frictional energy generating sufficient heat to bond the portions together. Other techniques include resistance welding, induction welding, and the like in which, after the portions are brought into contact with one another, an energy flux is introduced across their joining surfaces which causes them to be heated sufficiently to join the surfaces to one another.

U.S. Pat. No. 5,150,517 is an example of friction welding, whereas U.S. Pat. No. 6,291,806 is an example of typical induction heating wherein the coils are presented to the sides of the contacting joining surfaces to induce energy and thus heat at the interface. Such side presentation of the induction coils has a tendency to heat the regions of the joining surfaces near the edges of the material adjacent the induction coils at a faster rate than those regions further from the coils, thus producing a variation in the heat flow and heat affected zone in the area of the material adjacent the interface. In a demanding, highly loaded application such as pistons for diesel engines, it would be desirable to provide a weld joint that is uniform in its heat affected zone across the interface so as to minimize any variation in strength and integrity of the material.

U.S. Pat. No. 6,155,157 discloses a piston having first and second portions which are joined across two radially spaced sets of joining surfaces by means of friction welding. It will be appreciated that such an architecture would present a challenge to joining the portions by induction welding, since access to the regions where the joining surfaces are located is limited and, in the case of the internal cooling gallery, inaccessible to the positioning of any induction coil next to the mated joining surfaces. Based on the known existing technology in the field of pistons, a suitable technique for induction welding such complex architectures of pistons as those shown in the aforementioned '642 patent is not known to be in existence, and certainly is not known to be used due to the practical difficulties in adapting such induction heating technology to complex piston designs with multiple radially spaced joining surfaces.

Outside of the field of heavy-duty pistons, induction heating is used to join simple structures, such as butt-welding metal tubes that carry petroleum products. U.S. Pat. No. 6,637,642 discloses such a process. Such tubing is a simple, single walled cylindrical structure having flat, planer end faces. To join one end face to another, an induction coil is introduced between the end faces, and the end faces are heated to an elevated temperature, after which the coil is withdrawn and the end faces brought into engagement with one another to achieve a weld joint. Preferably, once the surfaces are brought into contact, they are twisted a small amount (a few degrees) to attain more intimate union of the weld surfaces. Surprisingly, the inventors have discovered that the induction welding technique heretofore limited to joining simple single walled cylindrical petroleum piping can be improved to be successfully employed to join complex piston structures in a manner to attain a strong, high integrity joint with a uniform but minimal heat affected zone across the interface of the joining surfaces.

SUMMARY OF THE INVENTION

A method of making a piston according to a first aspect of the invention includes fabricating first and second portions of the piston each having at least two joining surfaces. The portions are supported with the joining surfaces in spaced relation to one another. While spaced, the joining surfaces are heated to an elevated temperature and thereafter the heat discontinued and the joining surfaces brought into contact with one another to form a metallurgical bond across the joining surfaces. According to one aspect of the invention, the portions are pulled apart slightly while the bond is still hot, developing a thinned necked down region of the weld joint. This minimized material and saves weight and cost. A cavity may also be incorporated in the wall sections being joined to further enhance material and weight reduction.

According to another aspect in the invention, a method is provided for making a piston in which a joining surface of a first piston portion is supported in spaced relation to a joining surface of a second piston portion and, while spaced, the surfaces are heated and then brought together to form a metallurgical bond. The piston has radially spaced walls and the weld joints across the wall may lie in different planes. Following bonding, the weld joint may be further heated in a back temper heating operation to control the microstructure heating of the weld zone.

According to still a further aspect in the invention, a piston is provided having first and second portions with mating joining surfaces joined by an induction weld joint and having a heat affected zone which is uniform across the joint.

The invention has the advantage of providing a simple, low-cost method for welding multi-piece pistons.

The invention has the further advantage of providing a low-cost, high integrity weld joint that has a small and uniform heat affected zone adjacent the weld joint.

The invention has the further advantage of providing an induction heating method which permits precise control of the heating of the joining surfaces of the two piston parts, such that the joining surface of each piston part is not overheated or underheated during the heating of the joining surfaces to an elevated bonding temperature.

The invention has the further advantage of heating the joining surfaces of the piston portions, while spaced apart from one another, for a more precise, uniform and controlled heating of the surfaces as compared to heating the surfaces after they are joined to one another. With friction welding, for example, a piston having upper and lower crown parts with adjoining surfaces provided at the end faces of radially spaced inner and outer wall sections of the portions necessarily result in the outer wall being heated relatively more than the inner wall since the outer wall diameter is greater and thus rotates at a greater angular speed than that of the inner wall and consequently generates frictional heat at a greater rate than that of the heat generated at the inner wall. Unlike friction welding, induction heating makes it possible according to the invention to precisely control the relative heating of the inner and outer walls of such pistons, thereby providing more uniform weld joints as between the inner and outer walls.

Controlling the heating of inner and outer walls of the piston which are joined by the method of the invention avoids excessively heating the outer wall where the ring grooves are formed to better control the heat flow in the ring belt region as compared to friction welding.

Another advantage of induction heating according to the invention is that it requires relatively low compression force to join the parts following induction heating as compared to friction welding in which the heat needed for welding is generated by relative rotation of the parts while under relatively high compression loads (about 1,000 psi vs. 20,000 psi for friction welding). Consequently, the fixturing and equipment needed to hold and support the parts for induction welding according to the invention need not be as substantial as that required for friction welding. Moreover, the architecture of the piston is liberated somewhat since the structure does not have to withstand the heavy compression loading which is imparted during friction welding and which often exceeds the loading experienced during use of the piston. Consequently, thinner sections and lighter weight pistons are possible with induction welding at a cost savings to the manufacturer and recognized fuel and emission efficiencies by the user of such pistons.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
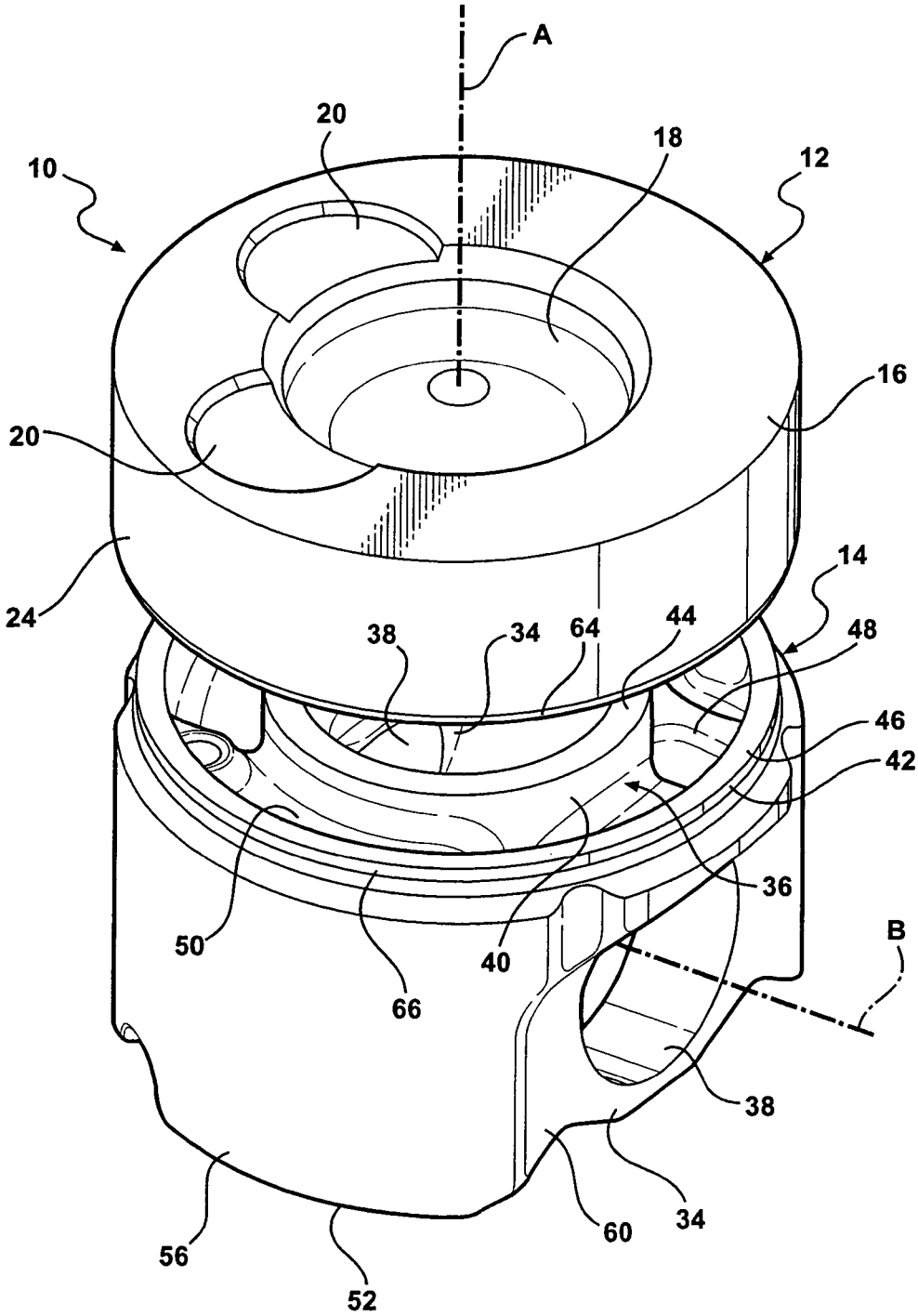
FIG. 1 is a perspective view of upper and lower piston parts prior to welding.

A piston constructed according to a presently preferred embodiment of the invention is shown generally at 10 in the drawings and is fabricated of at least two parts which are formed separately from one another in a manner to provide at least one and preferably at least two sets of circumferentially extending mateable joining surfaces which are initially spaced apart from one another and heated to a temperature sufficient for welding the parts, after which the heating of the surfaces is terminated and the surfaces joined to one another to effect a permanent weld between the parts.

In the illustrated embodiment, the piston 10 includes a first part 12 and a second part 14. Both parts 12, 14 are fabricated of metal, and preferably steel alloys, although the invention is not limited to these materials. The first and second parts may be cast, forged, fabricated of powder metal or any other process for making metal parts. The alloys used for the first and second parts 12, 14 may be the same or different, and thus the temperature at which the first and second parts need to be heated in order to effect welding of the materials may be the same or different, depending upon the requirements of a particular application.

In the illustrated embodiment, the first part 12 comprises and upper crown part of the piston 10, and the second part 14 is illustrated as a lower crown part of the piston 10 that complements the upper part 12 such that when joined, the parts 12, 14 make up the piston 10.

The first part 12 has an upper wall 16 formed with a combustion bowl 18 and, optionally one or more valve pockets 20. The combustion bowl 18 may be symmetric about a longitudinal axis A of the piston 10, or may be non-symmetrical as illustrated, if called for by a particular application. The valve pockets 22 are non-symmetrical with respect to the lower part 14. In other words, the valve pockets 20 and combustion bowl 18 are formed to have a particular position or orientation relative to the lower part 14, such that the angular location of the valve pockets 20 and combustion bowl positions 18 relative to the lower part 14 is critical to the operation of the piston 10 if such non-symmetrical features are provided to the piston 10.

The upper part 12 is formed with an inner annular wall 22 extending downwardly below the combustion bowl 18, and an outer annular wall or ring belt 24 that is spaced radially outwardly of the inner wall 22 and depends from the upper wall 16. The inner and outer walls 22, 24 are formed at or near their ends with respective joining surfaces 26, 28. The joining surfaces 26, 28 are circumferentially extending and preferably continuous and formed symmetrically with respect to the longitudinal axis A, such that the joining surfaces 26, 28 are concentric about the axis A.

Prior to welding of the first part 12 to the second part 14, the first part is preferably machined, and still further preferably final machined to provide a final finished surface to the combustion bowl 18, any valve pockets 20, the joining surfaces 26, 28, and annular cooling gallery recess 30 disposed between the inner and outer walls 22, 24 and extending upwardly from the joining surfaces 26, 28 toward the upper wall 16 to the outside of the combustion bowl 18, and an inner dome 32 extending radially inwardly of the inner wall 22. As will be described below, the piston 10 is formed with a series of ring grooves in the outer ring belt 24, but such ring grooves are preferably machined into the piston 10 following joining as will be explained.

Figure 2:
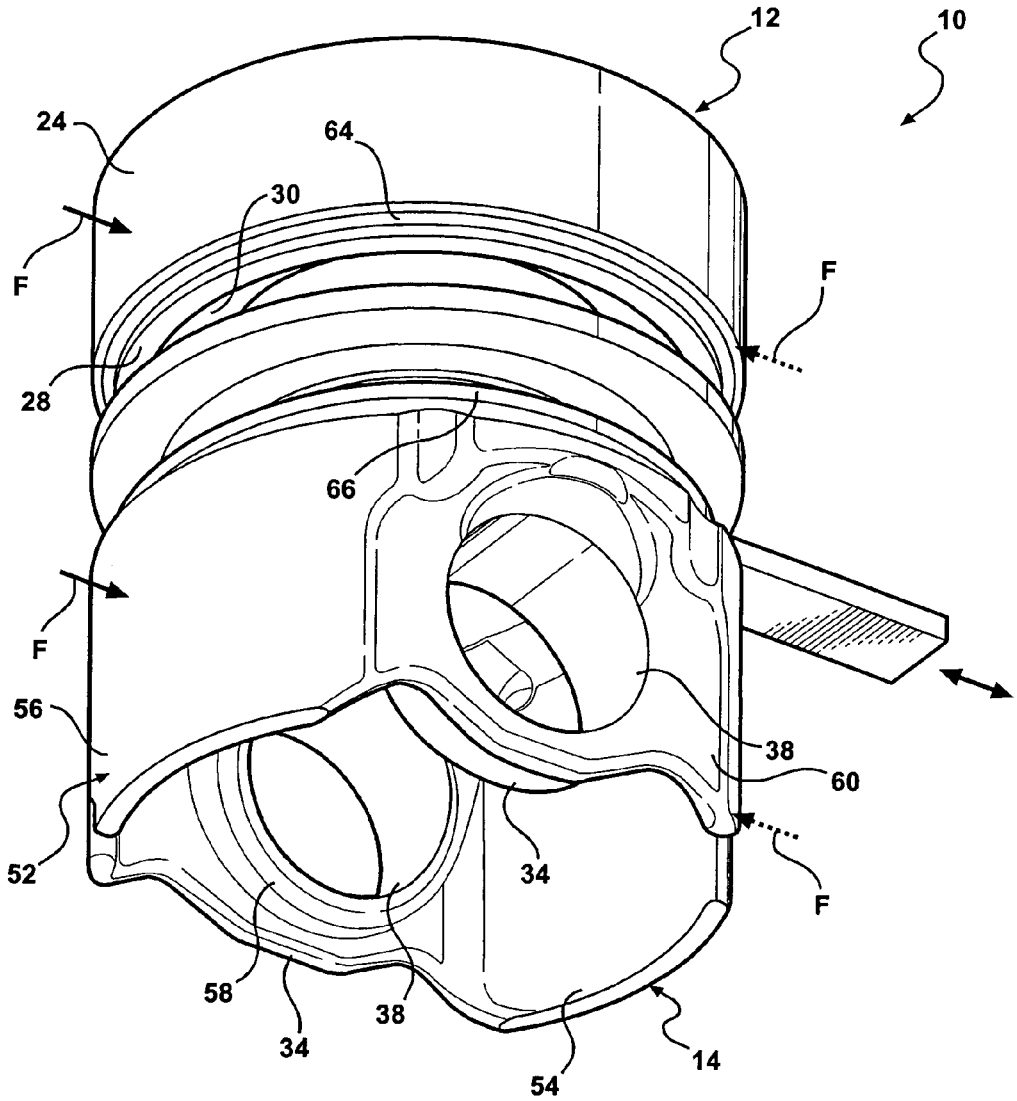
FIG. 2 is a view like FIG. 1 showing the parts fixtured and their joining surfaces heated.
Figure 3:
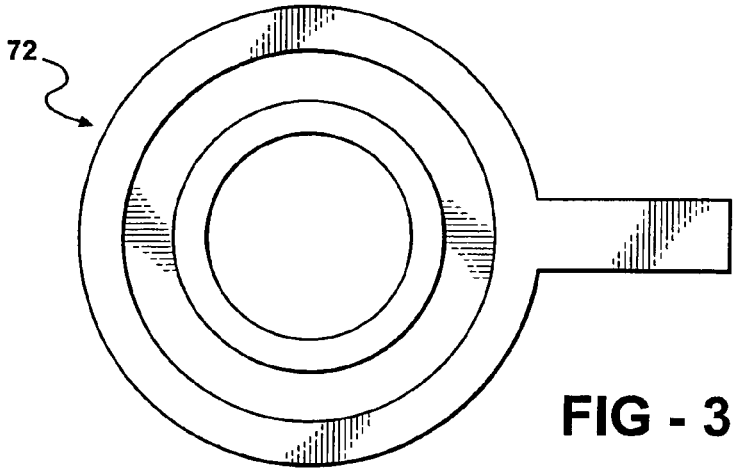
FIG. 3 is a plan view of the heating coil used in FIG. 2.

The second lower crown part 14 of the piston 10 is formed with a pair of pin bosses 34 extending downwardly from a neck 36 and formed with a set of pin bores 38 coaxially aligned along pin bore axis B. The neck 36 is formed with an inner annular wall 40 and an outer annular wall 42. The inner and outer walls 40, 42 are formed with respective joining surfaces 44, 46 which are circumferentially extending and preferably continuous and which align and mate with the joining surfaces 26, 28, respectively, of the inner and outer walls 22, 24 of the upper crown part 12. As best illustrated in FIG. 2, the joining surfaces 26, 28 of the upper crown part 12 and the joining surfaces 44, 46 of the lower crown part 14 are preferably contained in respective common planes to allow for easy introduction and removal of a heating coil between the parts as will be described below. However, while the planer arrangement of the joining surface is preferred, the invention is not limited to such an arrangement, and the joining surfaces can be arranged in different planes and have a variety of shapes, so long as the surfaces mate with one another (e.g., the mating surfaces being conical, stepped, or the like).

Prior to welding the lower crown part 14 to the upper crown part 12, the lower crown part 14 is preferably machined, and still more preferably final machined such that a final finish is formed on the pin bores 38, the neck 36, including a cooling-gallery recess 48 disposed between the inner and outer walls 40, 42 and extending downwardly from the joining surfaces 44, 46 to a bottom wall 50 that extends between and joins the lower ends of the inner and outer walls 40, 42 and is preferably formed as one piece therewith. The lower crown part 14 further includes a piston skirt 52 that is fabricated as a single, immovable structure with that of the lower crown part 14 and is fixed immovably to the pin bosses 34. Inner and outer surfaces 54, 56 of the piston skirt 52 are final machined prior to welding, as are inner and outer faces 58, 60 of the pin bosses 34. The pin bores 38 may further be final machined to include a ring groove 62 used for retaining a wrist pin within the pin bores 38 during operation of the piston 10.

Figure 4:
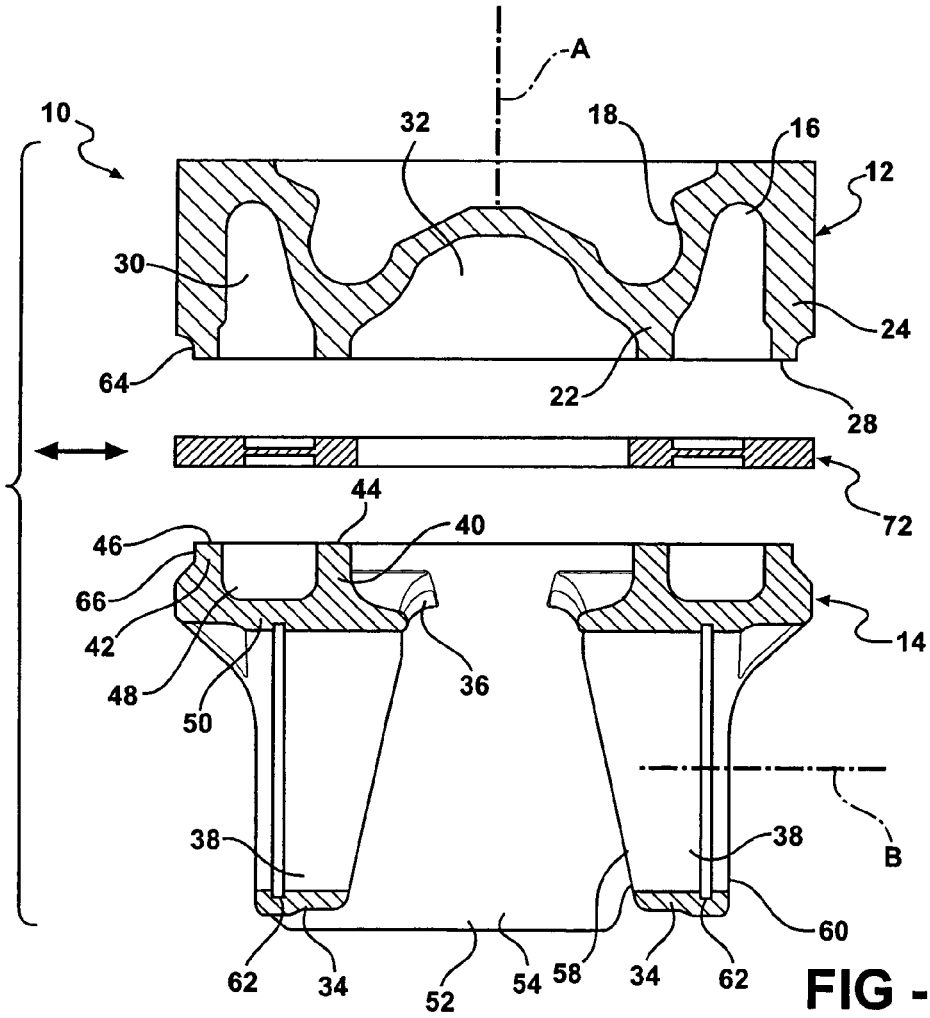
FIG. 4 is a cross-sectional view through the parts of FIG. 2.
Figure 5:
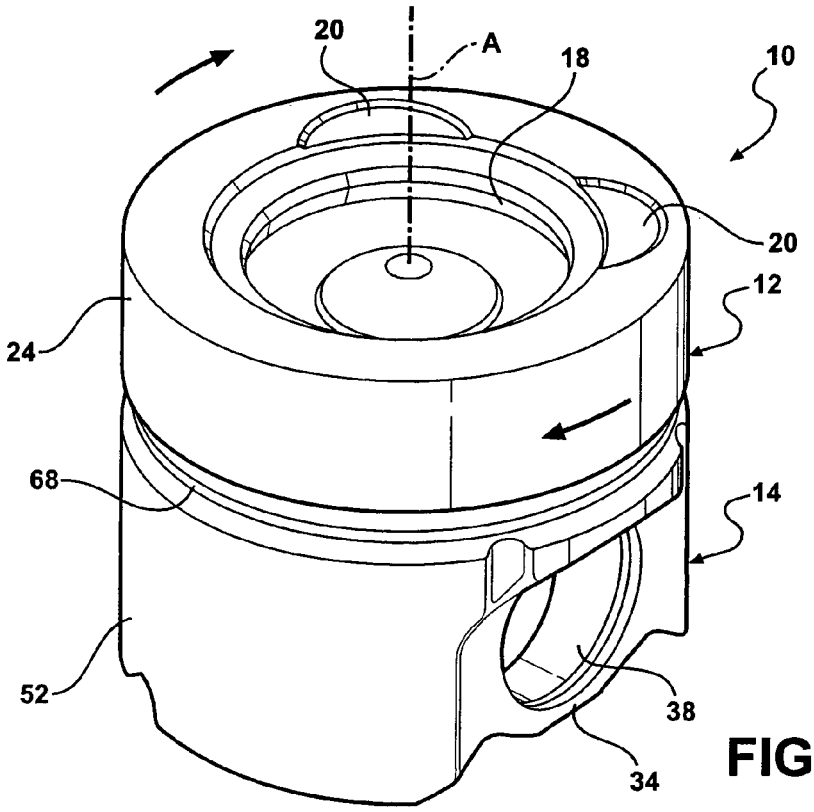
FIG. 5 is a view like FIG. 2 but showing the parts moved into contact with one another and twisted following heating.

The outer walls 24, 42 of the upper and lower crown parts 12, 14 may be formed adjacent their free ends with a radially reduced or neck region 64, 66 that is thinner and cross section in the region of the wall 24, 42 immediately away from the necked regions 64, 66. The joining surfaces 28, 46 are formed at the free ends of the necked regions 64, 66 according to the preferred embodiment, such that when the crown parts 12, 14 are joint as illustrated in FIG. 4, an oil drainage groove 68 is formed in the piston immediately above the pin bosses 34, and a weld joint 70 is formed across the oil drainage groove 68 at the location of the joining surfaces 26, 44 and 28, 46, respectively.

Turning now to further details of the welding operation, FIG. 2 shows the separately formed, pre-machined upper and lower crown parts 12, 14 fixtured with their respective joining surfaces 26, 28 and 44, 46 in axially aligned but spaced relation to one another. A heating coil, and preferably an induction heating coil 72, is extended into the space between the upper and lower crown parts 12, 14 and the coil 72 energized to induce heating of the joining surfaces to elevate them to a temperature sufficient to enable the joining surfaces to be bonded metallurgically to one another by means of an induction weld joint. Once heated to a sufficient elevated temperature, the heating coil 72 is quickly removed as illustrated in FIG. 4 and the upper and lower crown parts 12, 14 are relatively moved axially toward one another bringing their respective joining surfaces 26, 44 and 28, 46 into united engagement with one another while at a temperature sufficient for bonding. According to the invention, the joining surfaces of both the inner and outer walls are simultaneously heated to the appropriate bonding temperature or temperatures in a single operation by means of the heating coil 72. Preferably, the heating coil 72 comprises an induction heating coil which, when energized, induces a flow of electrons in the inner and outer walls to cause localized heating of the joining surfaces to an elevated bonding temperature, while the majority of the inner and outer wall material remains largely unaffected by the induction heating (i.e., is not raised to such an elevated temperature or for that matter to a temperature that would cause a change in microstructure of the material). Consequently, the induction heating produces a very controlled heat affected zone (HAZ) 74 which is substantially uniform across the width of the inner and outer walls.

Once the upper and lower crown parts 12, 14 have been heated and brought into contact with one another, the parts 12, 14 are preferably twisted by a relatively small amount to mix or smear the joining surfaces to achieve a very high integrity metallurgical union or bonding of the upper and lower crown part materials across the weld joint interface 70. The upper and lower crown parts 12, 14 are twisted in the range of a few degrees to less than one revolution, and preferably on the order of about 2–4 degrees. In the case where the upper or lower crown parts include asymmetrical features, such as the valve pockets 20 or offset combustion bowl 18, it is important that they be properly oriented with respect to the pin bore axis B in the final piston. Accordingly, the position and fixturing of the crown parts 12, 14 is carefully controlled such that prior to joining the features are misaligned with the axis B by an amount that, following twisting, brings the features into proper orientation with respect to the pin bore axis B.

Figure 6:
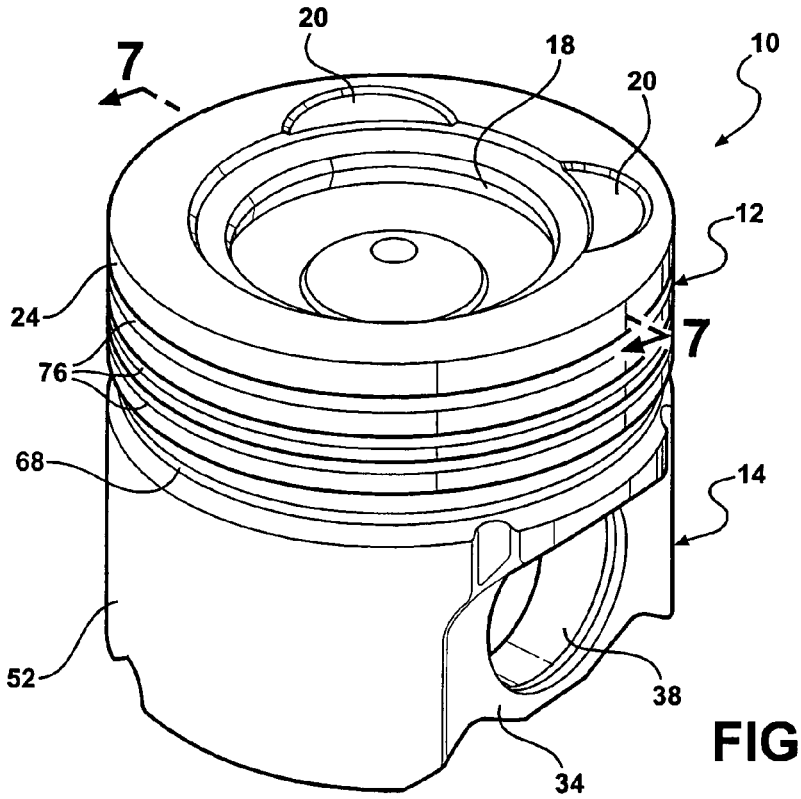
FIG. 6 is a perspective view of the final machined piston.
Figure 7:
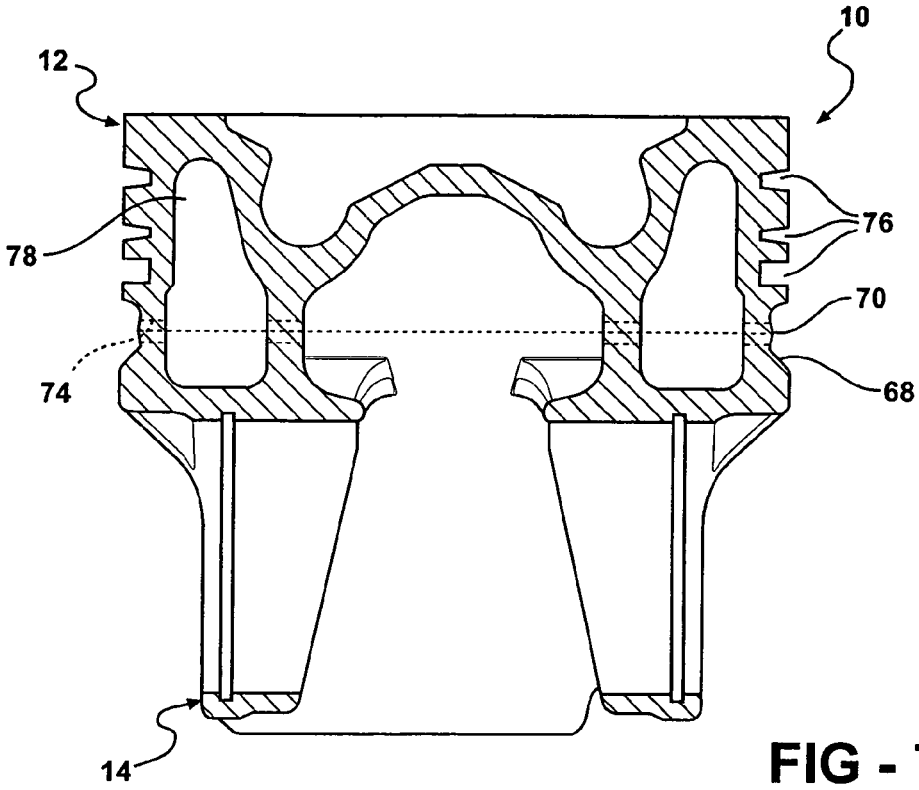
FIG. 7 is a cross-sectional view taken along lines 7—7 of FIG. 6.

As shown in FIG. 6, following welding, a final machining operation is performed on the piston 10 to provide a series of ring grooves 76 in the ring belt 24. The ring grooves 76 are preferably above the oil drainage groove 68 and thus the weld joint 70 is positioned in the outer wall 24, 42 below the lowest of the ring grooves 76.

As a result of welding the upper and lower crown parts 12, 14 a closed oil gallery 78 is formed between the crown parts 12, 14, bounded by the inner and outer walls 22, 40; 24, 42, the upper wall 16, and the bottom wall 50, and the weld joint 70 is exposed to the oil gallery 78. The crown parts 12, 14 may be formed or machined with appropriate oil feed and drainage passages into the oil gallery 78 which may advantageously be formed prior to welding as with the other final machined surfaces described previously.

Figure 8:
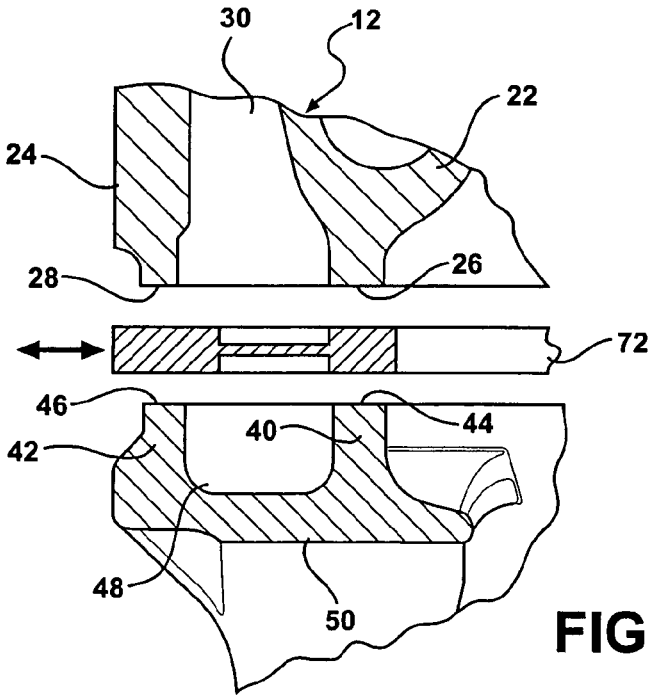
FIG. 8 is an enlarged fragmentary sectional view showing a heating coil positioned nearer to the joining surface of one of the piston parts than to the other.

It will be appreciated that since the joining surfaces 26, 28 and 44, 46 are heated by the heating coil 72 prior to joining the surfaces, rather than heating after the surfaces are joined, a direct and uniform heating of the joining surfaces is attainable and highly controllable. FIG. 8 illustrates a situation in which, because of different materials, geometries, or the like, the joining surfaces of the upper and lower crown parts would not heat uniformly if the coil were positioned an equal distance from each of the sets of joining surfaces. In the illustrated example of FIG. 8, the joining surfaces 26, 28 of the upper crown part 12 require a greater amount or more intense heating than that of the lower crown part, and thus the induction coil 72 is biased or shifted toward the joining surfaces 26, 28 so as to be relatively closer to the upper crown part than to that of the lower crown part. In this way, it is assured that the mating joining surfaces are properly heated to their required respective bonding temperatures, even when the bonding temperatures of the two parts may be different or one part may require more energy than the other part to attain a given bonding temperature. By shifting the coil 72 toward the part that requires more heating and away from the part that requires less heating, the appropriate equilibrium position can be achieved to minimize overheating and prevent underheating of the parts prior to bonding. This ability to control the relative heating of the upper and lower crown parts enables the upper and lower crown parts 12, 14 to be fabricated of different materials having different bonding temperatures, or architectures of the same or different material calling for different heating requirements in order to arrive at the appropriate bonding temperature at the appropriate time for joining with the complementing part.

The parts 12, 14 are preferably fabricated of steel, and more preferably of SAE 4140 grade. The parts 12, 14 are tempered prior to welding to provide a tempered martensite structure having a hardness in the range of 28–34 $R_c$. The hardness of the weld joint at the center is in the range of 35 to 50, and preferably toward the low end of the range. With controlled pre-heating, by the induction coil, of the joining surfaces the hardness of the weld joint can be controlled to within 38–42 $R_c$. The pre-heating effectively "soaks" the joining surfaces and penetrates the heat below the surface. This has the benefit of reducing the "quenching" action of the weld zone material following joining, with the goal of avoiding the formation of untempered martensite at the center, but rather bainite. The 4140 material has the benefit of a suppressed TTT curve that allows for controlled cooling within a reasonable time (i.e., seconds).

Figure 9:
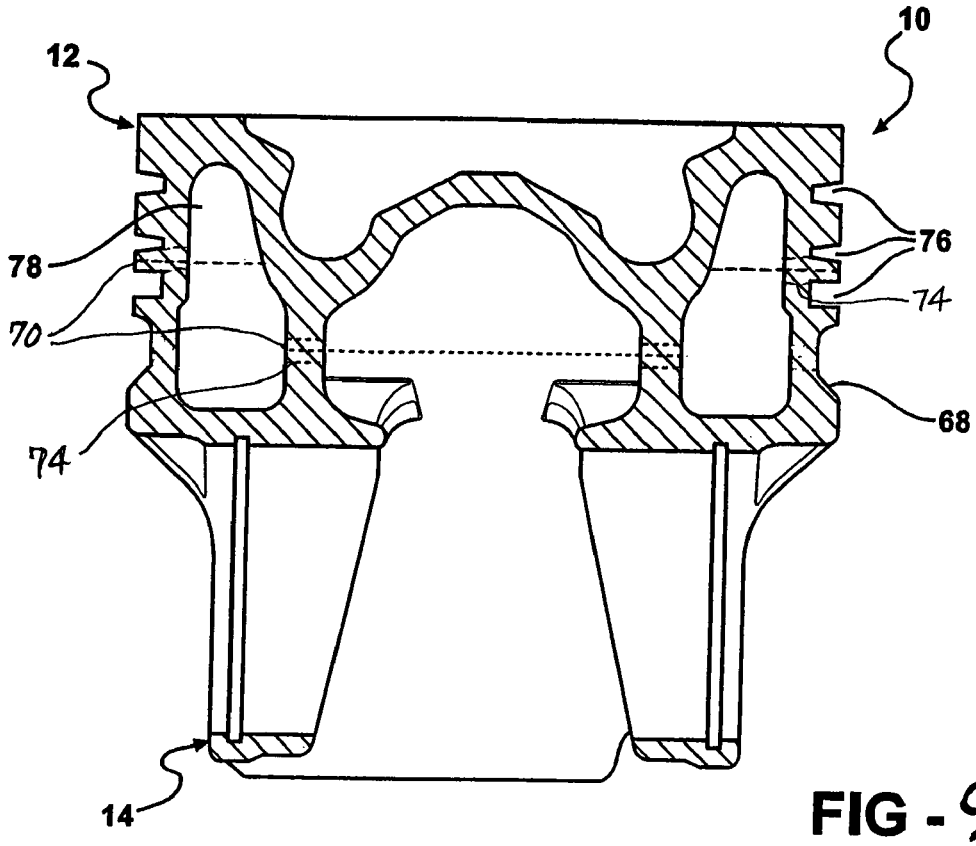
FIG. 9 is a cross-sectional view of a variation of the invention.

FIG. 9 shows a variation of the piston of FIG. 8, wherein the weld joint interface 70 across the upper and lower inner walls 22, 40 lies in a different plane than the weld joint interface 70 across the upper and lower outer walls 64, 66. Also shown, is the weld joint interface 70 of the outer walls 64, 66 being located in a ring land between adjacent ring grooves 76 and preferably above the lowest of the ring grooves.

Figure 10:
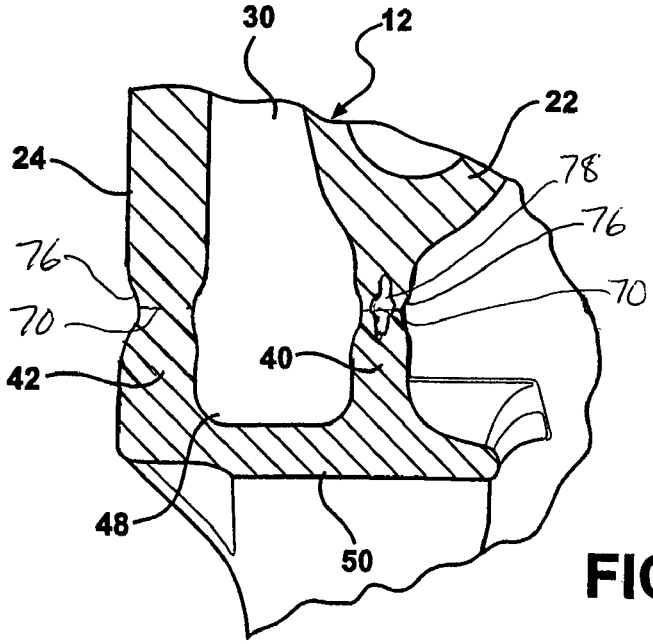
FIG. 10 is an enlarged fragmentary cross-sectional view of another variation of the invention.

FIG. 10 is another variation of the invention in which the upper and lower crown parts 12, 14, once heated, brought together and joined across the weld interface 70, are pulled slightly apart while the metal at the weld joint 70 is still in a heated plastic state to locally reduce the thickness of the joined wells from an initially slightly bulged condition to develop a thinned, necked region 76 at the walls in the region of the weld joint 70. In addition, at least the inner walls 22, 40 may be formed prior to welding with recesses in their end faces that, after welding, result in the formation of a cavity 78 with the walls 22, 40.

Following welding, the weld joint 70 may be heat treated by induction heating or other means to back temper the weld joint 70 in order to alter the microstructure of the metal at the weld joint 70, for example from martensite to tempered martensite.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A method of making a piston, comprising:

preparing a first portion of the piston having at least two associated circumferentially extending joining surfaces that are spaced from one another, preparing a second portion of the piston having at least two associated circumferentially extending joining surfaces that are spaced from one another;

supporting the first and second piston portions with the joining surfaces of the first portion being positioned out of contact with the joining surfaces of the second portion;

heating the joining surfaces of the first and second portions to an elevated bonding temperature and thereafter bringing the joining surfaces of the first and second portions into contact with one another and thereby forming a metallurgical bond therebetween, wherein the joining surfaces lie in different planes.

2. The method of claim 1 wherein the joining surfaces are heated by induction heating.

3. The method of claim 2 wherein while the first and second piston portions are supported out of contact with one another, their respective joining surfaces are disposed in spaced relation to one another forming a gap between the forming surfaces of the first portion and the forming surfaces of the second portion.

4. The method of claim 3 wherein the induction heating is carried out by extending an induction coil into the gap and energizing the coil to heat the joining surfaces after which the coil is withdrawn from the gap before bringing the joining surfaces of the first and second portions into contact.

5. The method of claim 4 wherein during contact of the joining surfaces, the first and second portions are twisted relative to one another to slide the joining surfaces across one another.

6. The method of claim 5 wherein the twisting occurs over less than 360°.

7. The method of claim 5 wherein the twisting occurs over less than 180°.

8. The method of claim 5 wherein the twisting occurs over less than 90°.

9. The method of claim 5 wherein the twisting occurs over less than 45°.

10. The method of claim 5 wherein the twisting occurs over less than 30°.

11. The method of claim 5 wherein the twisting occurs over less than 20°.

12. The method of claim 5 wherein the twisting occurs over less than 10°.

13. The method of claim 5 wherein the twisting occurs over less than 5°.

14. The method of claim 4 including positioning the induction coil closer to the joining surfaces of one of the first and second portions than to the other of said joining surfaces.

15. The method of claim 14 including fabricating the first and second portions from different materials.

16. The method of claim 1 including final machining a combustion bowl in the first portion and final machining pin bosses and pin bores in the second portion prior to heating and bonding of the joining surfaces.

17. The method of claim 1 wherein the resultant piston is provided with an induction weld joint in a ring belt of the piston, and locating the induction weld joint below the lowest of any ring grooves provided in the ring belt.

18. The method of claim 1 including machining valve pockets in the first portion prior to heating and bonding with the second portion.

19. The method of claim 1 including forming the joining surface on mating wall sections of the first and second portions.

20. The method of claim 19 wherein the wall sections are annular.

21. The method of claim 20 wherein the joining surfaces are provided in necked down end regions of the wall sections.

22. The method of claim 1 wherein any heating required to elevate the temperature of the joining surfaces to the bonding temperature is discontinued prior to and after the joining surfaces are brought into contact with one another.

23. The method of claim 1 wherein an annular cooling gallery is formed between the first and second portions bounded by a pair of radially spaced side walls, a top wall, and a bottom wall.

24. The method of claim 23 wherein the joining surfaces are formed in the side walls such that a weld joint is formed in each side wall at the joining faces exposed to the cooling gallery.

25. The method of claim 1 wherein the first portion is formed with a combustion bowl and the second portion is formed with a pair of pin bosses and a piston skirt fixed immovably to the pin bosses.

26. The method of claim 1 wherein the first portion is machined with features that are asymmetrical across a plane containing a longitudinal axis of the first portion.

27. A method of fabricating a piston comprising:

fabricating a first piston portion having at least one associated mating surface;

fabricating a second piston portion separately from the first piston portion having at least one associated mating surface;

spacing the mating surface of the first piston portion from the mating surface of the second piston portion;

with the mating surfaces spaced, heating the surfaces to a temperature sufficient for welding of the surfaces;

bringing the heated mating surfaces into contact with one another to weld the piston portions across the joined mating surfaces, and, while the joined mating surfaces are still hot, pulling the piston portions axially away from one another to reduce the thickness of the mating surfaces.

28. The method of claim 27 wherein the joining surfaces are heated by induction heating.

29. The method of claim 27, including forming a cavity across the mating surfaces.

30. The method of claim 27, wherein following welding, the joined mating surfaces are further heat treated to back temper the joined mating surfaces.

* * * * *

UNITED STATES PATENT AND TRADEMARK OFFICE

CERTIFICATE OF CORRECTION

PATENT NO. : 7,005,620 B2
APPLICATION NO. : 10/735798
DATED : February 28, 2006
INVENTOR(S) : Carmo Ribeiro, Thomas Egerer and Randall Gaiser It is certified that error appears in the above-identified patent and that said Letters Patent is hereby corrected as shown below:

| Column | Line | |
|---|---|---|
| 1 | 46 | Replace " 642 " with -- 157 -- |

Signed and Sealed this

Fifth Day of December, 2006

JON W. DUDAS
*Director of the United States Patent and Trademark Office*